United States Patent [19]

Bassett

[11] Patent Number: 4,819,359

[45] Date of Patent: Apr. 11, 1989

[54] PISTOL REST

[76] Inventor: Earl R. Bassett, 820 Wepo Trail, Flagstaff, Ariz. 86001

[21] Appl. No.: 145,414

[22] Filed: Jan. 19, 1988

[51] Int. Cl.[4] ..... F41C 29/00

[52] U.S. Cl. ..... 42/94; 89/37.04

[58] Field of Search ..... 42/94; 89/37.04; 73/167

[56] References Cited

U.S. PATENT DOCUMENTS

| | | | |
|---|---|---|---|
| 125,743 | 4/1872 | Lehnert | 89/37.04 |
| 2,458,608 | 1/1949 | Lea | 89/37.04 |
| 2,731,829 | 1/1956 | Wigington et al. | 89/37.04 |
| 2,877,689 | 3/1959 | Pribis | 89/37.04 |
| 3,343,411 | 9/1967 | Lee | 89/37.04 |
| 4,621,563 | 11/1986 | Poiencot | 89/37.04 |

*Primary Examiner*—Charles T. Jordan

*Attorney, Agent, or Firm*—Leon Gilden

[57] ABSTRACT

A pistol machine rest is provided with a horizontal member configured for replaceable positioning of a pistol securement member proximate a first terminal end thereof and provided with a shock absorbency organization at the second end with a pivoted securement of the horizontal member between the first and second ends. The horizontal member is vertically positionable to accommodate varying targets at varying distances with a plurality of leg supports for stable securement of the pistol rest.

8 Claims, 5 Drawing Sheets

PISTOL REST

BACKGROUND OF THE INVENTION

1. Field of the Invention

The present invention relates to machine rests for pistols and more particularly relates to a new and improved pistol rest which provides stable securement and accommodation of a variety of pistols of a compact size and effective organization for use in the testing of pistols and ammunition.

2. Description of the Prior Art

The use of machine rests in the testing of firearms and associated ammunition is well known in the prior art. As may be appreciated, these devices have typically been of elaborate construction or of substantial size to require an inordinate amount of space in use, and as such their employment in the firearm testing has been somewhat limited. In this connection, there have been several attempts to develop pistol rest apparatus which may be easily and efficiently utilized when desired. For example, U.S. Pat. No. 125,743 to Lehnert provides for a pivotal table top releasably securable at a forwardmost position to enable rearward pivoting and attachment for associated firearms. While an effective securement means for a firearm, the Lehnert patent fails to provide the shock absorbency or compactness of structure required in the testing of pistols and the like.

U.S. Pat. No. 2,458,608 to Lea sets forth a pistol machine rest wherein a pistol is securable to a plurality of spaced plates and said plates are in turn securable to a support surface. The Lea patent provides means for securing a pistol and further provides a modicum of adjustability but is of rudimentary form and of much more limited applicability than the instant invention.

U.S. Pat. No. 2,731,829 to Wigington et al sets forth a pistol rest including shock absorbency members in the form of springs coaxially positioned about guide rails and while an improvement over the previous pistol-type machine rests, the Wigington patent fails to provide a dampening mechanism as well as a convenient organization for use in pistol testing forums.

U.S. Pat. No. 2,877,689 to Pribis sets forth a further pistol rest wherein a storage compartment for a pistol has elements stored therein for positioning within a box-like portion for positioning of pistol therein. The patent is of interesting structure relative to pistol stands and the like but is of relatively remote organization and function as related to the instant invention.

U.S. Pat. No. 3,343,411 to Lee sets forth a pistol rest pivotally secured at a rearwardmost position with a forwardly oriented adjusting screw threadedly secured to an elongate engagement member to secure an associated pistol. The Lee patent fails to present an effective compact organization for the provision of dampening means in the use of pistol rests and the like with various shock absorbency members.

As such it may be appreciated that there is a continuing need for a new and improved pistol rest apparatus which addresses both the problem of effectiveness and stability and in this respect, the present invention substantially fulfills this need.

SUMMARY OF THE INVENTION

In view of the foregoing disadvantages inherent in the known types of pistol rests now present in the prior art, the present invention provides a pistol rest apparatus wherein the same is of compact construction and of effective and efficient organization to enable securement of a wide range of pistols and further permits an adjustable positioning of a pistol rest relative to intended targets as well as providing multiple shock absorbing features. As such, the general purpose of the present invention, which will be described subsequently in greater detail, is to provide a new and improved pistol rest which has all the advantages of the prior art pistol rests and none of the disadvantages.

To attain this, the present invention comprises a horizontal support member including a pistol rest securement means securable proximate a first end and a shock absorbency member secured proximate a second end with a pivotal axis positioned between the first and second end and an adjustment screw enabling vertical adjustment of the horizontal member for adjusting aiming of a secured pistol. A triangulated leg support arrangement is provided to effect stability and securement of the pistol rest apparatus to an associated surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pistol rest which has all the advantages of the prior art pistol rests and none of the disadvantages.

It is another object of the present invention to provide a new and improved pistol rest which may be easily and efficiently manufactured and marketed.

It is a further object of the present invention to provide a new and improved pistol rest which is of a durable and reliable construction.

An even further object of the present invention is to provide a new and improved pistol rest which is susceptible of a low cost of manufacture with regard to both materials and labor, and which accordingly is then susceptible of low prices of sale to the consuming public, thereby making such pistol rest economically available to the buying public.

Still yet another object of the present invention is to provide a new and improved pistol rest which provides in the apparatuses and methods of the prior art some of the advantages thereof, while simultaneously overcoming some of the disadvantages normally associated therewith.

Still another object of the present invention is to provide a new and improved pistol rest wherein the same accommodates a variety of pistols.

Yet another object of the present invention is to provide a new and improved pistol rest wherein the same effects shock absorption of associated impacting of a discharged pistol secured to the rest.

Even still another object of the present invention is to provide a new and improved pistol rest wherein the same may be adjustable to accommodate varying distances of target and impacts of bullets.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic view taken in elevation of the instant invention along the lines 4—4 of FIG. 2 in the direction indicated by the arrows.

FIG. 6 is an end orthographic view of pistol securement means of the instant invention.

FIG. 7 is a side orthographic view of the pistol securement means of the instant invention.

DESCRIPTION OF THE PREFERRED EMBODIMENT

Figure 1:
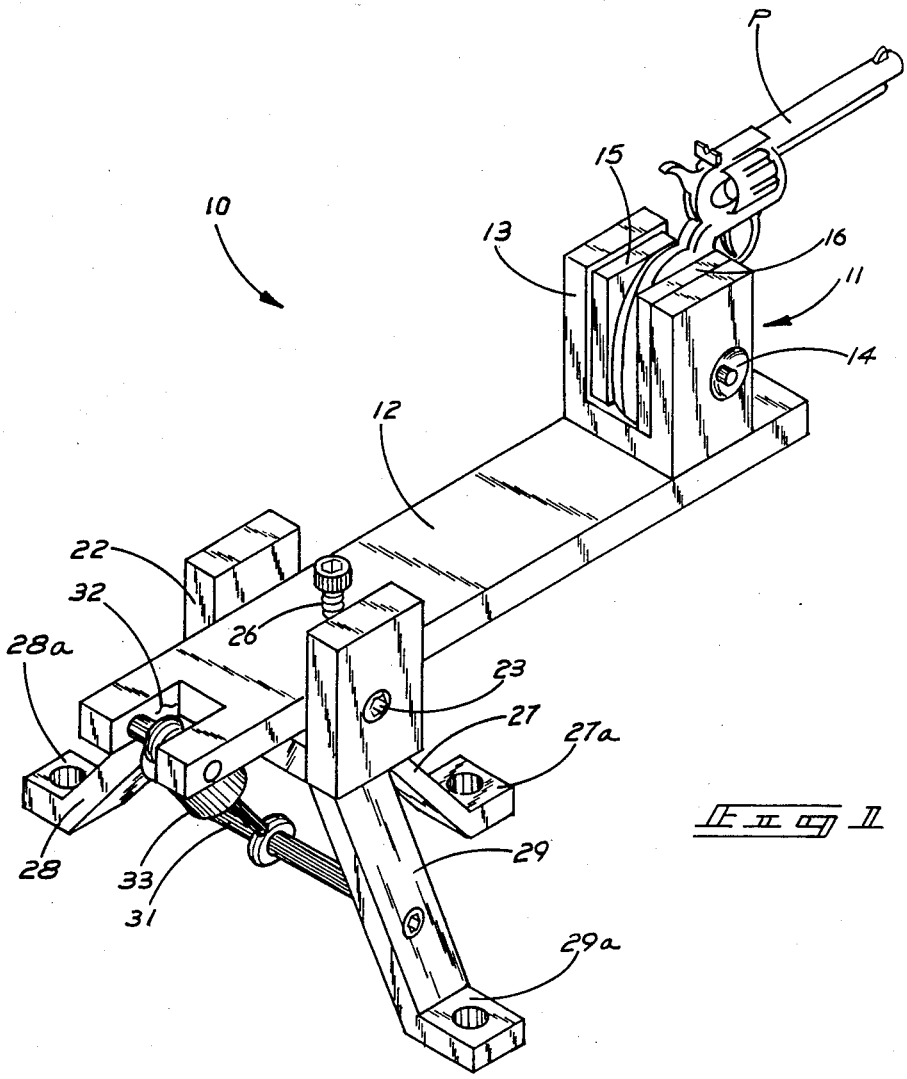
FIG. 1 is an isometric illustration of the pistol rest of the instant invention.
Figure 2:
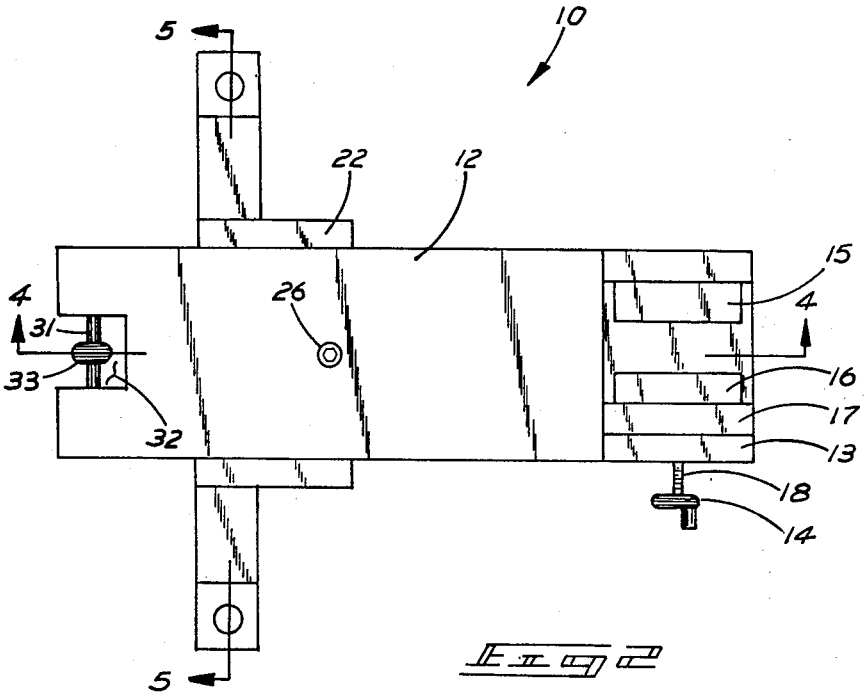
FIG. 2 is a top orthographic of the pistol rest of the instant invention.
Figure 3:
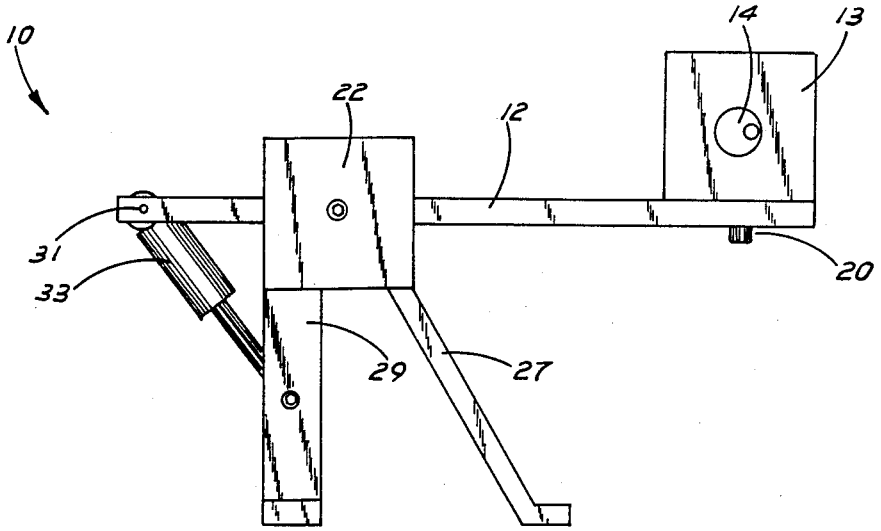
FIG. 3 is an orthographic side view taken in elevation of the pistol rest of the instant invention.
Figure 3:
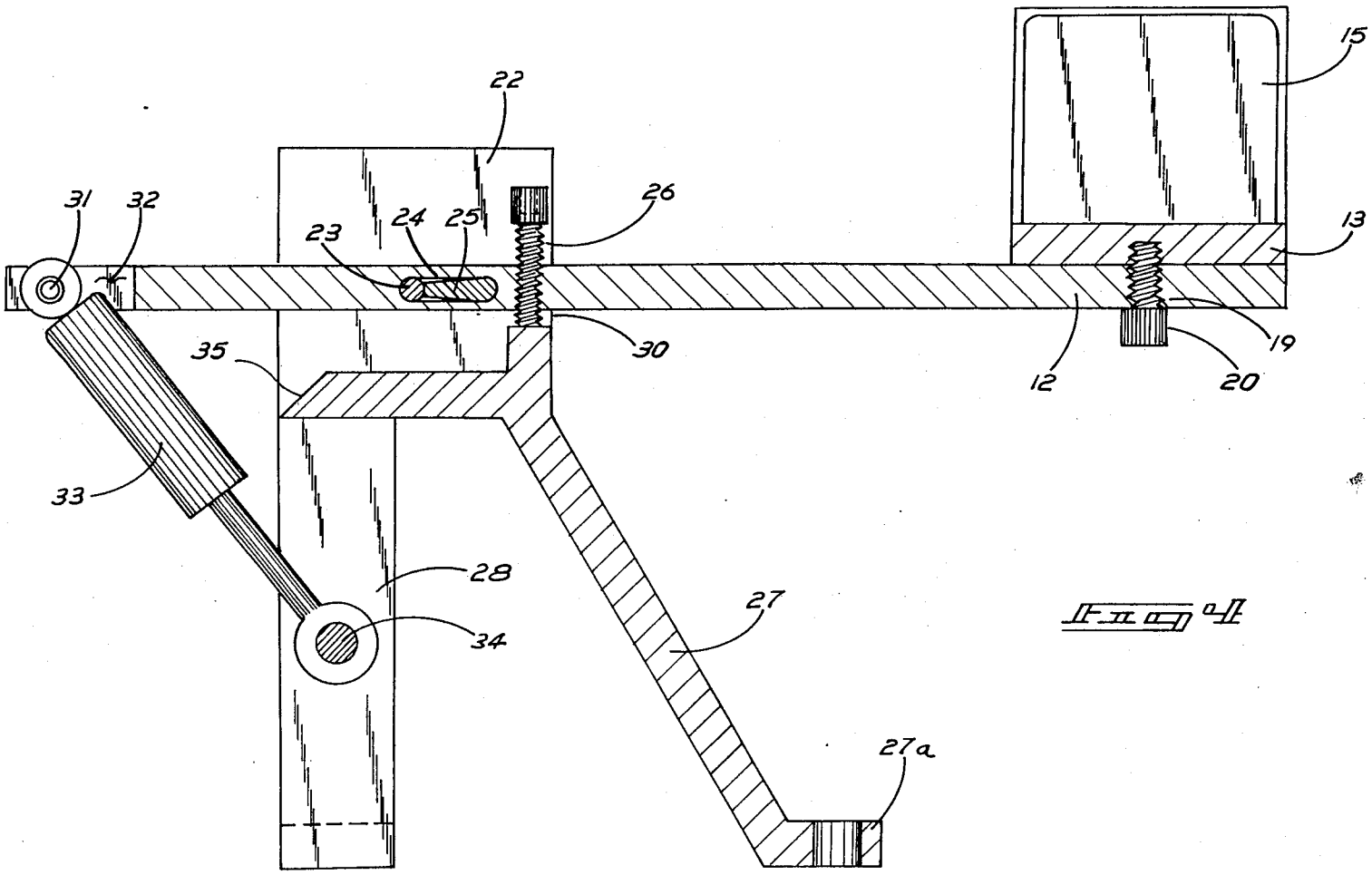

With reference now to the drawings, and in particular to FIGS. 1 to 7 thereof, a new and improved pistol rest embodying the principles and concepts of the present invention and generally designated by the reference numeral 10 will be described.

More specifically, it will be noted that the pistol rest apparatus 10 essentially comprises a securement means 11 for the rigid securement of a pistol therein removably securable to a support plate 12. The securement means 11 includes a "U" shaped pistol mount 13 formed with a generally planar horizontal lower surface including two upwardly depending legs, essentially as illustrated. A first jaw face 15 is rigidly secured to an upstanding first leg of the "U" shaped pistol mount 13 wherein a second jaw face 16 is positionable relative to first jaw face 15 by means of its attachment to a reciprocable second jaw support 17 displaceable within the "U" shaped pistol mount 13 by a rotatable handle 14 that may rotate a first threaded member 18, as illustrated in FIG. 6, that is itself secured to reciprocable second jaw support 17 to enable the accommodation of a variety of pistol grips between the first and second jaw faces 15 and 16 respectively. The first and second jaw faces 15 and 16 are preferably formed of a polymeric-like material of memory retentent character to enable a non-marring securement of a pistol grip therebetween.

The "U" shaped pistol mount 13 is securable proximate a first terminal end of support plate 12 by means of a second threaded member 19 formed with a manually manipulatable screw head 20 where essentially, as illustrated in FIG. 4, the second threaded member 19 is positionable through an opening in support plate 12 and by virtue of manually manipulatable screw head 20 clampingly engages the "U" shaped pistol mount 13 to support plate 12 at a terminal end thereof.

Figure 5:
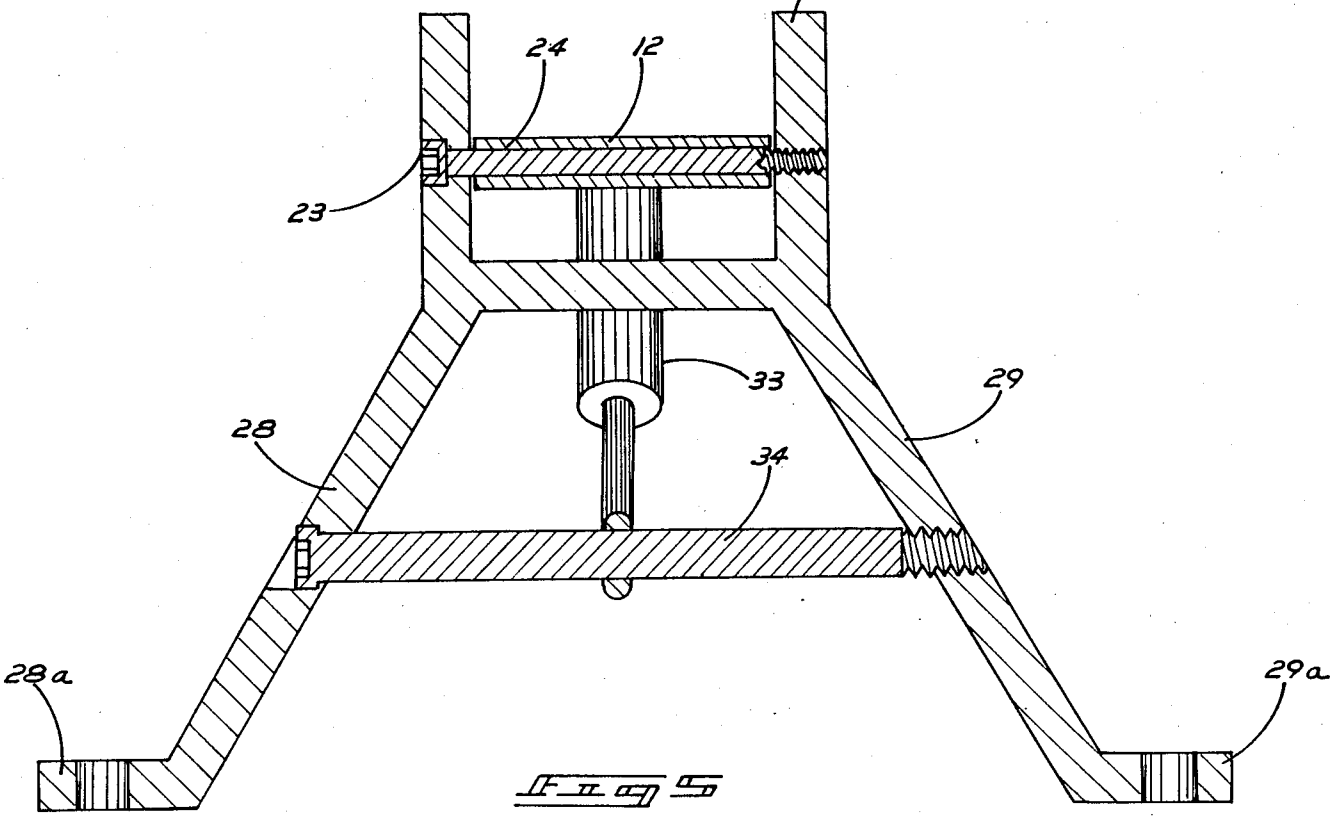
FIG. 5 is an orthographic view taken in elevation of the pistol rest of the instant invention along the lines 5—5 of FIG. 2 in the direction indicated by the arrows.
Figure 11:
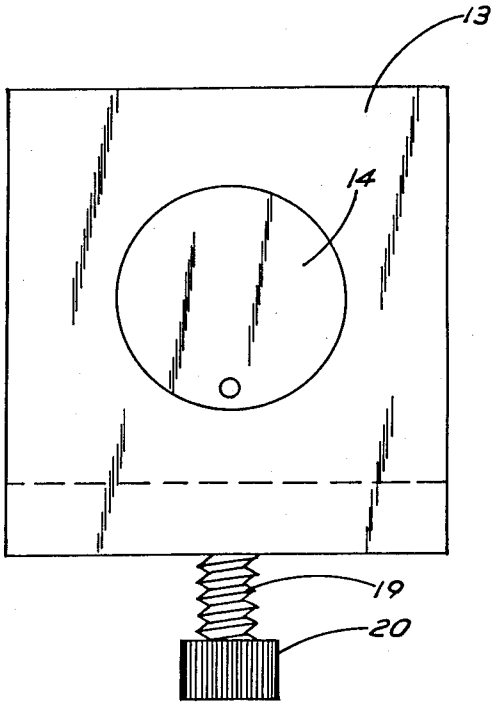
Figure 10:
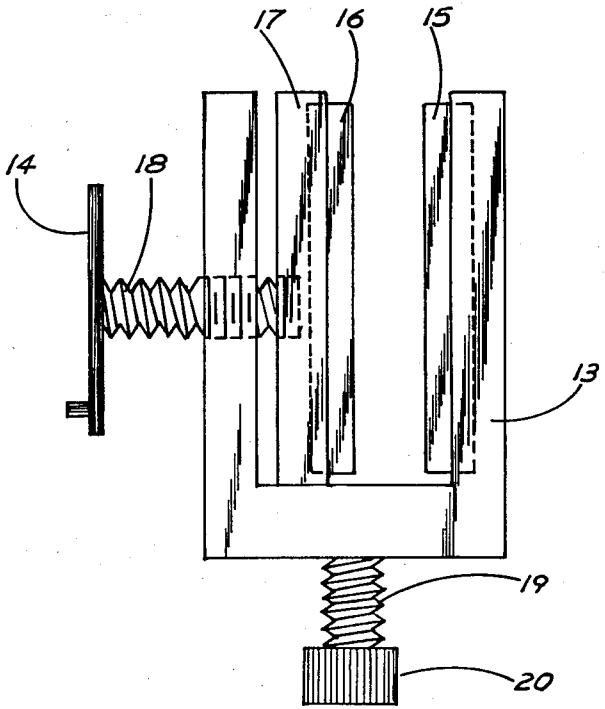

A "U" shaped support yoke 22 remote from the pistol securement means 11 pivotally secures support plate 12 therebetween. A first pivotal rod 23 is secured between the upstanding legs of support yoke 22, essentially as illustrated in FIG. 5. Reference to FIG. 4 illustrates a third threaded adjustment member 26 threadedly securable through an opening in support plate 12 and engaging an abutment surface 30 of the support yoke 22. The adjustment member 26 enables adjustment of the secure means 11 and thereby enables a variety of pistols and ammunitions to be utilized in conjunction with pistol rest 10.

The first pivot rod 23 is positioned through an opening 24 transversely of support plate 12 wherein said opening is oblong and has secured therein a leaf spring 25, as illustrated in FIG. 4, to resist horizontal displacement of support 12 upon pistol discharge and thereby reduces impact loading of the various structural elements of pistol rest 10.

Integrally secured to support yoke 22 are a plurality of legs 27, 28, and 29, essentially as illustrated, formed with "L" shaped support feet **27*a*, 28*a*, and 29*a* respectively. The respective support feet are formed with openings therethrough for securement of the support feet and pistol rest apparatus 10** to a desired securement surface (not illustrated).

With reference to FIG. 4, dampening of the effects of discharge of a pistol secured within the securement means 11 is effected by utilization of a dampener 33 secured to support plate 12 by use of a second pivoted rod 31 wherein the dampener 33 is positioned relative support plate 12 within a "U" shaped recess 32 at a second end remote from the end supportive of securement means 11. The dampener 33 is secured at its lowermost portion to a third pivot rod 34 secured to respective legs 28 and 29, as illustrated in FIG. 5. The arcuate repositioning of support plate 12 upon discharge of a pistol secured therein is limited by abutment surface 35 that will contact the associated underlying surface of support plate 12 should failure of the dampener or mountings thereof occur.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pistol rest apparatus for the securement and discharge of a pistol comprising:

a support plate including a first and second end, a securement means for securement of a pistol including a "U" shaped pistol mount, said mount includes a first stationary jaw surface and a second reciprocable jaw mounted within said "U" shaped pistol mount, and a first end of a dampener secured to said support plate at the second end and a second end of said dampener secured to a support means underlying said support plate wherein said support means is secured to a "U" shaped yoke means for pivotal securement of said support plate intermediate said first and second ends of said support plate, and wherein said "U" shaped pistol mount is removably secured to said support plate including a threaded securement means positionable through an opening in said support plate to secure said "U" shaped pistol mount to said support plate, and wherein said dampener is positioned within a "U" shaped recess formed within the second end of said support plate.

2. A pistol rest apparatus as set forth in claim 1 wherein said support means includes a plurality of legs integrally secured to said "U" shaped yoke means wherein said second end of said dampener is secured to a rod integrally attached to at least a plurality of said support legs.

3. A pistol rest apparatus as set forth in claim 2 wherein said support legs are formed with "L" shaped feet with openings formed in said "L" shaped feet for attachment to a support surface.

4. A pistol rest apparatus as set forth in claim 3 wherein said support means includes an abutment surface underlying said support surface to limit arcuate pivotment of said support plate relative to said support means.

5. A pistol rest apparatus as set forth in claim 4 wherein vertical positioning of said "U" shaped pistol mount is provided by means of a third threaded adjustment member positionable through a further opening in said support plate and in contact with an abutment surface formed on said support means.

6. A pistol rest apparatus as set forth in claim 5 wherein the pivotal securement of said support plate to said "U" shaped yoke means includes a first pivot rod positionable through an oblong opening in said support plate transversely thereof and attached to upstanding legs of said "U" shaped yoke means on either side of said support plate.

7. A pistol rest apparatus as set forth in claim 6 wherein a leaf spring is positioned within said oblong opening in abutment with the first pivot rod to provide resilient absorbency of impact loading to said pivot rod upon discharge of a pistol secured within said "U" shaped pistol mount.

8. A pistol rest apparatus as set forth in claim 7 wherein said first stationary jaw surface and said second reciprocable jaw are formed of a polymeric memory retentent material for non-marring securement of a pistol secured between said first stationary jaw surface and said second reciprocable jaw.

* * * * *